US006094914A

United States Patent [19]

Zörner

[11] Patent Number: 6,094,914

[45] Date of Patent: Aug. 1, 2000

[54] METHOD AND DEVICE FOR COOLING A LOW-PRESSURE TURBINE SECTION

[75] Inventor: Walter Zörner, Baiersdorf, Germany

[73] Assignee: Siemens Aktiengesellschaft, Munich, Germany

[21] Appl. No.: 09/033,142

[22] Filed: Mar. 2, 1998

Related U.S. Application Data

[63] Continuation of application No. PCT/DE96/01506, Aug. 12, 1996.

[30] Foreign Application Priority Data

Aug. 31, 1995 [JP] Japan ..... 195 32 199

[51] Int. Cl.[7] ..... F01K 1/04

[52] U.S. Cl. ..... 60/643; 60/662

[58] Field of Search ..... 60/643, 662

[56] References Cited

U.S. PATENT DOCUMENTS 4,891,937 1/1990 Noguchi et al. .

FOREIGN PATENT DOCUMENTS

0508387A1 10/1992 European Pat. Off. .
905137 2/1954 Germany .
4129518A1 3/1993 Germany .
4336143A1 5/1995 Germany .
202313 4/1939 Switzerland .
1250097 10/1971 United Kingdom .

OTHER PUBLICATIONS

Soviet Patent Abstract No. 85–151282 (Kachan et al.), dated May 12, 1982.
Soviet Patent Abstract No. 85–010296 (Khrambrov et al.), dated May 15, 1984).

*Primary Examiner*—Noah P. Kamen
*Attorney, Agent, or Firm*—Herbert L. Lerner; Laurence A. Greenberg; Werner H. Stemer

[57] ABSTRACT

A method and a device for cooling a low-pressure turbine section of a steam turbine connected in a water/steam circuit, include feeding a coolant flow through parts of the low-pressure turbine section, in particular during idling operation. Condensate bled from a condenser connected downstream of the steam turbine is used as a coolant for especially effective cooling while simultaneously utilizing heat obtained in the process. The condensate emits heat absorbed during the cooling to the water/steam circuit. A coolant line which is connected to the outflow side of the condenser is connected to the low-pressure turbine section. A heat exchanger is connected to the coolant line and in the water/steam circuit.

11 Claims, 2 Drawing Sheets

METHOD AND DEVICE FOR COOLING A LOW-PRESSURE TURBINE SECTION

CROSS-REFERENCE TO RELATED APPLICATIONS

This application is a continuation of International Application Ser. No. PCT/DE96/01506, filed Aug. 12, 1996, which designated the United States.

BACKGROUND OF THE INVENTION

FIELD OF THE INVENTION

The invention relates to a method for cooling the low-pressure turbine section of a steam turbine connected in a water/steam circuit, in which a coolant flows through the low-pressure turbine section, in particular during idling operation. The invention also relates to a device for carrying out the method.

A turbo set having a heating steam turbine in many cases is constructed in such a way that, when heat is extracted from an intermediate-pressure turbine section, a low-pressure turbine section or each low-pressure turbine section receives no substantial steam supply and therefore works in idling operation. However, that leads to increased heating of the blading in the low-pressure turbine section of the heating steam turbine, in particular in the case of a full heat extraction and a shut-off low-pressure turbine section.

It is known from German Published, Non-Prosecuted Patent Application DE 41 29 518 A1, corresponding to U.S. Pat. No. 5,490,386, to feed cooling steam and/or condensate to the low-pressure turbine section through a tap provided on the turbine in order to avoid inadmissible warming-up effects through ventilation losses in the blading. However, that involves a relatively large heat loss, since the heat contained in the cooling steam together with the lost heat resulting essentially from the ventilation is dissipated through the condenser connected downstream of the steam turbine and is therefore not available for heating purposes. Since an appropriately large quantity of the cooling steam for reducing a temperature rise in the blading resulting from the ventilation has to be selected, the heat losses are relatively high.

SUMMARY OF THE INVENTION

It is accordingly an object of the invention to provide a method and a device for cooling a low-pressure turbine section, which overcome the herein afore-mentioned disadvantages of the heretofore-known methods and devices of this general type and which provide simple and especially effective cooling of the low-pressure turbine section, in particular in idling and/or low-load operation.

With the foregoing and other objects in view there is provided, in accordance with the invention, a method for cooling a low-pressure turbine section of a steam turbine, which comprises bleeding condensate for use as a coolant from a condenser connected downstream of a steam turbine in a water/steam circuit; passing the coolant through a low-pressure turbine section of the steam turbine, in particular during idling operation; and initially cooling down at least a partial flow of the coolant after flowing through the low-pressure turbine section by emitting heat to the water/steam circuit, and then feeding back the at least partial flow to the water/steam circuit.

The invention is based on the concept that a suitable coolant for cooling the low-pressure turbine section during idling or low-load operation has, as a further property in addition to its effective cooling property, the ability to recover as large a portion as possible of the lost heat caused by ventilation of the final stages of the turbine. To this end, the coolant is to have an appropriately low temperature. Since the condenser is in operation to maintain a necessary vacuum even during idling of the low-pressure turbine section, the use of condensate as a coolant is therefore especially suitable, especially since it also has a suitable temperature.

In accordance with another mode of the invention, the coolant is directed in a closed cooling loop and it is passed through passages in the guide blade, or in each guide blade, of the low-pressure turbine section.

In accordance with a further mode of the invention, the coolant is passed through passages inside the casing of the low-pressure turbine section, i.e. along outer or inner contours of the inner casing.

In accordance with an added mode of the invention, the partial flow of the warmed-up or heated-up coolant is fed to the condenser on its outflow side after cooling-down is effected, while the other partial flow is fed directly to the condenser on its inflow side.

In accordance with an additional mode of the invention, if the warmed-up coolant is fed to the water/steam circuit, this is effected at a suitable point with regard to its pressure and temperature and by controlling the final temperature of the warmed-up coolant. An especially suitable control of the final temperature of the coolant is provided if the coolant flow fed to the low-pressure turbine section is set.

With the objects of the invention in view, there is also provided, in a steam turbine plant including a water/steam circuit, a steam turbine connected in the water/steam circuit and having a low-pressure turbine section, and a condenser connected downstream of the steam turbine and having an outflow side, a device for cooling the low-pressure turbine section, comprising a condensate coolant line connected to the outflow side of the condenser, connected to the low-pressure turbine section, and leading into the water/steam circuit; and a heat exchanger having a primary side connected in the coolant line downstream of the low-pressure turbine section in flow direction and a secondary side connected in the water/steam circuit for transferring heat contained in the condensate.

Through the use of this heat exchanger or cooler, the heat contained in the warmed-up coolant can be extracted for recovery in an especially suitable manner and emitted to the water/steam circuit at a suitable point where a low condensate pressure prevails, e.g. downstream of a first low-pressure preheater.

In accordance with another feature of the invention, the coolant line is connected to the condensate collecting tank or hot well provided directly below the condenser.

In accordance with a further feature of the invention, the warmed-up coolant is fed back into the water/steam circuit at a suitable point, and the coolant line is connected to the pressure side of a condensate pump connected in the water/steam circuit.

In accordance with an added feature of the invention, alternatively or in addition, a circulating pump is connected in the coolant line. The inclusion of a circulating pump is especially expedient if the coolant is directed in a separate cooling loop with the coolant line directly connected to the hot well of the condenser.

In accordance with a concomitant feature of the invention, there is provided a device for controlling a final temperature of the coolant heated during the cooling.

Other features which are considered as characteristic for the invention are set forth in the appended claims.

Although the invention is illustrated and described herein as embodied in a method and a device for cooling a low-pressure turbine section, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
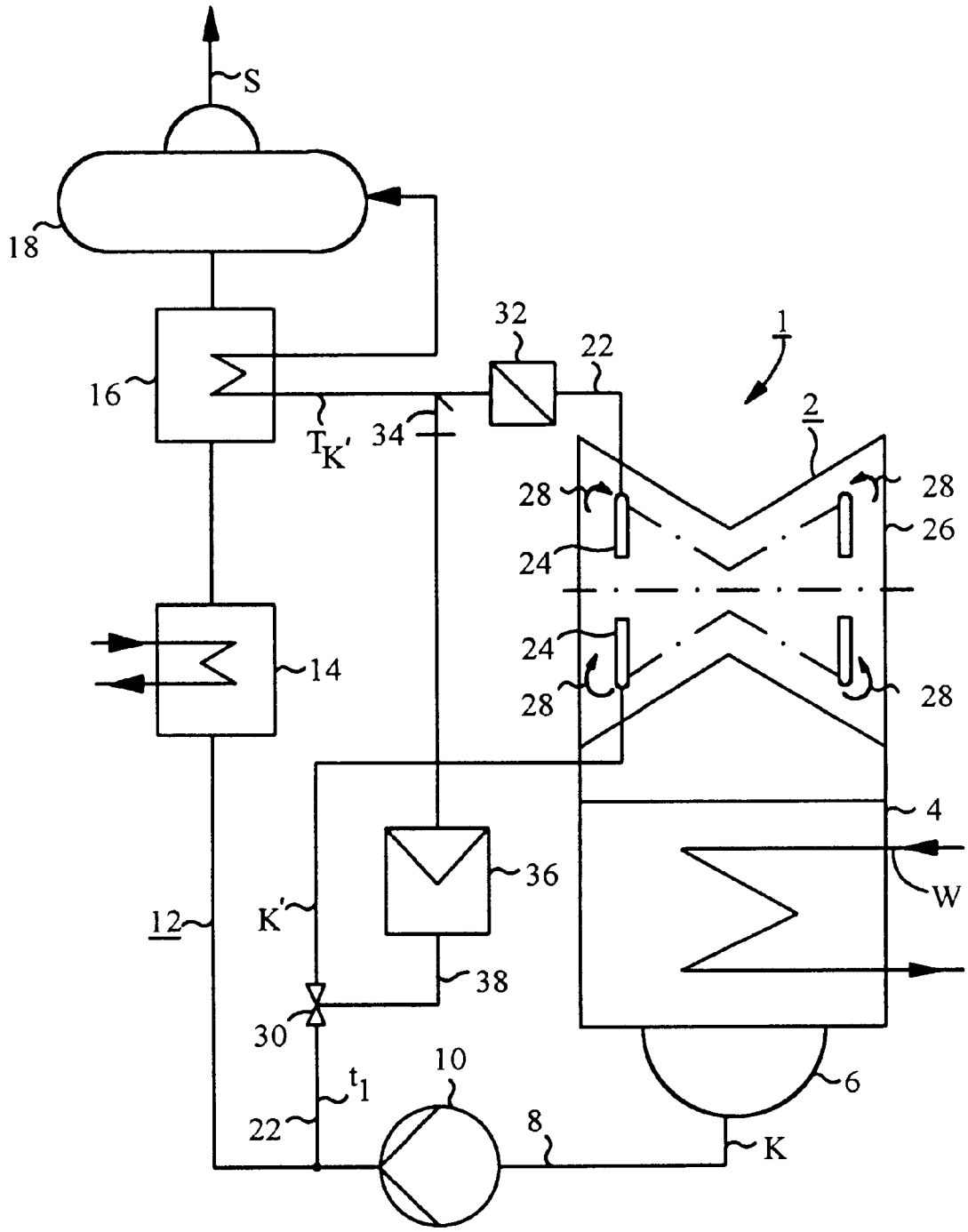
FIG. 1 is a functional diagram of a device for performing a method for cooling guide blades of a low-pressure turbine section through the use of condensate bled downstream of a condensate pump.

Referring now to the figures of the drawings in detail and first, particularly, to FIG. 1 thereof, there is seen merely a final stage of a steam turbine 1 having a double-flow low-pressure turbine section 2, a condenser 4 disposed below the low-pressure turbine section 2 and a collecting tank or hot well 6 of the condenser 4 for condensate K. The hot well 6 is connected in a partially illustrated water/steam circuit 12 of the steam turbine 1 through a condensate line 8 having a condensate pump 10. The condensate line 8 leads through a first preheater 14 and a second preheater 16 into a feedwater tank 18 that is likewise connected in the water/steam circuit 12.

During operation of the steam turbine 1, condensate K flows out of the hot well 6 of the condenser 4 through the condensate line 8 and the condensate pump 10 as well as through the preheaters 14 and 16 into the feedwater tank 18, where it is collected and normally de-aerated. From there, it is fed as feedwater S in a non-illustrated manner into evaporator and superheater heating surfaces connected in the water/steam circuit 12, for generating steam for the steam turbine 1. The steam is expanded in the steam turbine 1 to perform work and is then passed into the condenser 4, where it condenses. The condensate K is collected in the hot well 6.

A partial flow $t_1$ of the condensate K from the hot well 6 of the condenser 4 is fed to the low-pressure turbine section 2 through a coolant line 22 connected on the pressure side of the condensate pump 10 at the condensate line 8. A quantity of condensate or coolant K' directed per unit of time through the coolant line 22, i.e. the coolant flow, is set in the process. In the exemplary embodiment, the coolant K' flows through guide blades 24 of the low-pressure turbine section 2, of which only two are shown. To this end, passages are provided inside the guide blades 24 in a non-illustrated manner and the passages are interlinked in a cooling loop. Alternatively or in addition, the coolant K' may also flow through passages which are provided inside an inner casing 26 of the low-pressure turbine section 2 and which may be outer or inner contours of the inner casing 26. This is indicated by arrows 28.

A valve 30 is connected in the coolant line 22 on the inflow side for setting the quantity of coolant K' which is fed to the low-pressure turbine section 2 per unit of time, i.e. for setting the condensate partial flow $t_1$. The coolant line 22 is directed through the second preheater 16 on the outflow side, i.e. in the direction of flow of the coolant K' downstream of the low-pressure turbine section 2, and leads into the feedwater tank 18. A non-return valve 32 is connected in the coolant line 22 between the low-pressure turbine section 2 and the second preheater 16.

When flowing through the guide blades 24 and/or the inner casing 26, the partial flow $t_1$ of the coolant K' directed through the coolant line 22 absorbs the heat arising through ventilation during idling or low-load operation, from the low-pressure turbine section 2, and emits this heat in the second preheater 16 to the condensate K flowing to the feedwater tank 18. The coolant K' which is cooled down as a result is mixed in the feedwater tank 18 with the condensate K that is fed directly to the latter.

The coolant flow is varied through the use of the valve 30 in order to set a final temperature $T_{K'}$ of the coolant K' which is warmed-up or heated up as a result of the cooling of the low-pressure turbine section 2. To this end, a temperature sensor 34 measures the current final temperature $T_{K'}$ of the warmed-up coolant K' on the outflow side of the low-pressure turbine section 2 connected in the coolant line 22 inside the cooling loop. A controlled quantity which is determined with reference to the measured final temperature $T_{K'}$ and a predeterminable desired temperature is transmitted by a controller module 36 through a signal line 38 leading to the controllable valve 30 for setting the coolant flow $t_1$.

Figure 2:
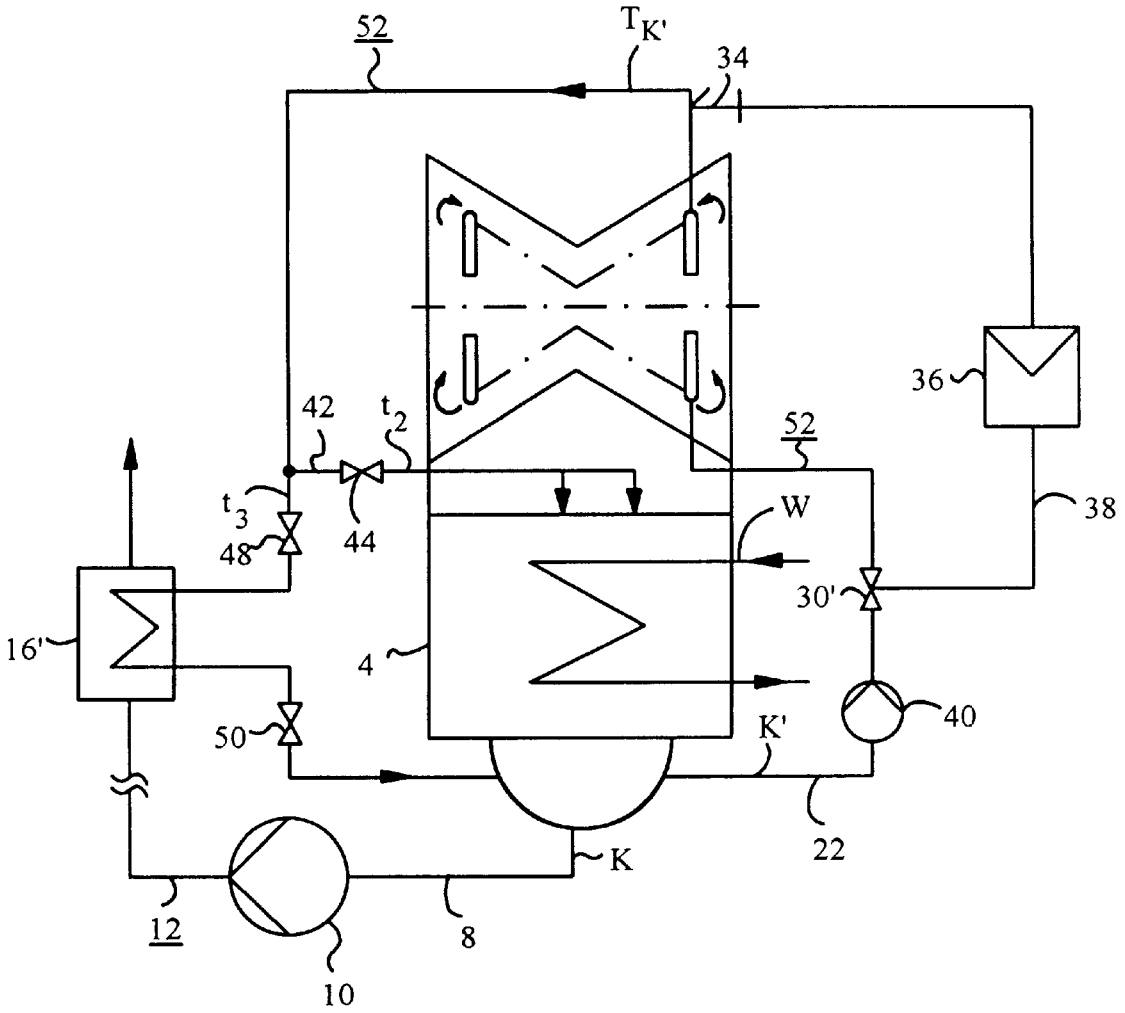
FIG. 2 is an alternative functional diagram of a device having a cooling loop directed through a condenser hot well.

In the exemplary embodiment according to FIG. 2, the cooling of the low-pressure turbine section 2 is effected in an especially simple manner by condensate K being delivered as coolant K' from the hot well 6 of the condenser 4 through a circulating pump 40 connected in a coolant line 22' to the guide blades 24 of the low-pressure turbine section 2. The coolant K' is heated itself during the cooling. A partial flow $t_2$ of the coolant K' through a partial-flow line 42 which is connected on the outflow side to the coolant line 22' and in which a valve 44 is connected, is directed through tubing of the condenser 4. In the process, the heated coolant K' emits its heat to cooling water W flowing through the condenser 4. A quantity of coolant K' which is bled from the hot well 6 per unit of time is in turn set through the use of a valve 30' connected in the coolant line 22'. A final temperature $T_{K'}$ of the heated coolant K' is measured through the use of a temperature-measuring sensor 34. The valve 30' is in turn controlled by the controller module 36 as a function of the final temperature $T_{K'}$.

A remaining partial flow $t_3$ of the heated coolant K' can be set through the use of valves 48 and 50 and is in turn directed through a heat exchanger or preheater 16', in the course of which it emits its heat at a suitable point to the water/steam circuit 12 of th e steam turbine 1. In the exemplary embodiment according to FIG. 2, the coolant K' is therefore directed in a separate cooling circuit 52 which is connected directly through the condenser 4.

In order to avoid erosion on the turbine blading, the guide blades 24 may also be heated with steam through their cooling passages. For this purpose, that steam should be bled from a turbine tap in a manner which is known per se and is therefore not shown herein.

I claim:

1. A method for cooling a low-pressure turbine section of a steam turbine, which comprises:

drawing condensate for use as a coolant from a condenser connected downstream of a steam turbine in a water/steam circuit;

passing the coolant through a low-pressure turbine section of the steam turbine; and cooling down at least a partial flow of the coolant after flowing through the low-pressure turbine section by emitting heat to the water/steam circuit, and then feeding back the at least partial flow to the water/steam circuit.

2. The method according to claim 1, which comprises passing the coolant through the low-pressure turbine section during idling operation.

3. The method according to claim 1, which comprises passing the coolant through at least one guide blade of the low-pressure turbine section.

4. The method according to claim 1, which comprises passing the coolant through passages inside an inner casing of the low-pressure turbine section.

5. The method according to claim 1, which comprises directing the coolant in a separate cooling circuit, and feeding back the coolant into the condenser after flowing through the low-pressure turbine section.

6. The method according to claim 1, which comprises setting the coolant flow for controlling a final temperature of the at least partial flow downstream of the low-pressure turbine section.

7. In a steam turbine plant including a water/steam circuit, a steam turbine connected in the water/steam circuit and having a low-pressure turbine section, and a condenser connected downstream of the steam turbine and having an outflow side, a device for cooling the low-pressure turbine section, comprising:

a condensate coolant line connected to the outflow side of the condenser, connected to the low-pressure turbine section, and leading into the water/steam circuit; and a heat exchanger having a primary side connected in said condensate coolant line downstream of the low-pressure turbine section in condensate flow direction and a secondary side connected in the water/steam circuit for transferring heat contained in the condensate.

8. The device according to claim 7, wherein the condenser has a hot well connected to said coolant line.

9. The device according to claim 7, including a condensate pump connected in the water/steam circuit and having a pressure side connected to said coolant line.

10. The device according to claim 7, including a circulating pump connected in said coolant line.

11. The device according to claim 7, including a device for controlling a final temperature of the coolant heated during the cooling.

* * * * *